US005454380A

United States Patent [19]

Gates

[11] Patent Number: 5,454,380

[45] Date of Patent: Oct. 3, 1995

[54] ERGONOMIC HAND SUPPORT FOR USE DURING A WORK OPERATION TO PREVENT THE RISK OF ADVERSE MEDICAL CONDITIONS, SUCH AS CARPAL TUNNEL SYNDROME

[76] Inventor: Randy J. Gates, 2255 N. 2nd St., Rogers, Ark. 72756

[21] Appl. No.: 305,310

[22] Filed: Sep. 15, 1994

[51] Int. Cl.[6] ..... A61G 15/00; B26B 27/00

[52] U.S. Cl. ..... 128/845; 128/879; 30/298

[58] Field of Search ..... 128/846, 877, 128/878, 879, 845; 2/17, 20, 161.5, 161.6; 81/387; 30/298

[56] References Cited

U.S. PATENT DOCUMENTS

| | | | |
|---|---|---|---|
| 348,528 | 8/1886 | Ludwig | 30/298 |
| 685,574 | 10/1901 | Comboie | 128/879 |
| 703,211 | 6/1902 | Morgan . | |
| 811,067 | 1/1906 | Johnson | 30/298 |
| 1,192,160 | 7/1916 | Boice | 30/298 |
| 1,217,905 | 3/1917 | Boice | 30/298 |
| 1,403,002 | 1/1922 | Barns | 30/298 |
| 1,583,754 | 5/1926 | Rogers . | |
| 3,074,399 | 1/1963 | Bitting . | |
| 3,885,249 | 5/1975 | De Brabander . | |
| 4,149,296 | 4/1979 | Stanford . | |
| 4,203,495 | 5/1980 | Crownover | 2/17 |
| 4,273,339 | 6/1981 | Fortunato . | |
| 4,447,912 | 5/1984 | Morrow . | |
| 4,502,688 | 3/1985 | Papp . | |
| 4,522,197 | 6/1985 | Hasegawa . | |
| 4,619,250 | 10/1986 | Hasegawa . | |
| 4,624,016 | 11/1986 | Luevano . | |
| 4,850,341 | 7/1989 | Fabry . | |
| 4,883,073 | 11/1989 | Aziz . | |
| 4,899,763 | 2/1990 | Sebastian . | |
| 4,984,828 | 1/1991 | Lepissier . | |
| 5,003,637 | 4/1991 | Lonon . | |
| 5,025,560 | 6/1991 | Townsend | 30/298 |
| 5,031,640 | 7/1991 | Spitzer . | |
| 5,131,151 | 7/1992 | Agase | 30/298 |
| 5,214,799 | 6/1993 | Fabry . | |
| 5,256,136 | 10/1993 | Sucher . | |

FOREIGN PATENT DOCUMENTS

| | | |
|---|---|---|
| 9300834 | 1/1993 | WIPO . |

*Primary Examiner*—Michael A. Brown

*Attorney, Agent, or Firm*—Shlesinger, Arkwright & Garvey

[57] ABSTRACT

An ergonomic hand support for use during the work operation to prevent, or significantly reduce, the risk of adverse medical conditions, such as Carpal Tunnel Syndrome, includes an enclosure member which is generally configured for receiving a user's hand and is made of a generally rigid material. The enclosure member includes top, bottom, sides, front and rear which together define an elongated, continuous recess for accommodating the user's hand. The recess extends generally the length of the enclosure member. At least one of the sides includes a side wall which extends from the bottom of the enclosure member. The hand support further includes means for immobilizing the user's hands in the recess and means mounted at a preselected location on the enclosure member for releasably holding a work tool, such as a knife.

23 Claims, 5 Drawing Sheets

ERGONOMIC HAND SUPPORT FOR USE DURING A WORK OPERATION TO PREVENT THE RISK OF ADVERSE MEDICAL CONDITIONS, SUCH AS CARPAL TUNNEL SYNDROME

FIELD AND HISTORICAL BACKGROUND OF THE INVENTION

The present invention is directed generally to hand support devices and more particularly to an ergonomic hand support for use during a work operation to prevent, or significantly reduce, the risk of adverse medical conditions, such as Carpal Tunnel Syndrome.

Cumulative Trauma Disorder (CTD) is a broad generic term that is used to describe injuries that occur to the body as a result of actions which are repetitive in nature. In addition to affecting the associated nerve, the injury may also be caused to the tissue associated with it. There are several types of injuries that are associated with the hand, one of the most widely known is the Carpal Tunnel Syndrome. While it is an advanced stage of injury, a more common element of this condition is repetitive motion injuries to the tendons and ligaments of the wrist and hand.

Carpal Tunnel Syndrome has become to be known as a common and troublesome condition that interferes with the use of the hand. Typically, it is caused by a narrowing effect of the carpal canal leading to compression injury of the median nerve in the wrist. The carpal tunnel is a canal in the wrist through which the median nerve and flexor tendons pass from the forearm of a person to the hand. Among many causes, it is believed that prolonged, repetitive motion, such as at a keyboard or in a manual cutting operation in a poultry or meat processing/packaging plant, is the main factor for causing Carpal Tunnel Syndrome. Specifically, it is caused when too much pressure is exerted on the median nerve that extends through the wrist region of a person. A variety of factors are responsible for creating this pressure causing considerable pain to the affected person with the condition frequently worsening and resulting in permanent nerve damage.

In particular, there are four main factors which individually or together contribute to or cause this adverse medical condition of the hand. First factor is the gripping of an object by the hand. During a gripping action, carpal tunnel is compressed as a result of the surrounding tissues squeezing the median nerve, tendons and vessels that pass through the tunnel. This squeezing action can be observed by looking at the palm side of the wrist and closing and squeezing the hand.

The second aspect of the Carpal Tunnel Syndrome is a repetitive action by the hand which alone can be the cause of this condition. However, this condition is compounded when the gripping action takes place concurrently with the repetitive motion. In addition, improper arching of the wrist during the repetitive motion further contributes to compression of the carpal tunnel.

The third factor which contributes to or causes the Carpal Tunnel Syndrome is insufficient relieving of the pressure on the tunnel in between the repetitive action. For instance, if an adequate resting cycle is followed, the tissues can recover upon relieving of the pressure. If the period between cycles of motion is not sufficiently long, however, the tissues develop permanent injury occurring from prolonged contraction as a result of the compression of the tunnel.

Fourth and finally, improper positioning of the hand during use could also contribute to the syndrome. It is important to educate people about the proper and correct ergonomic use of the hand during a repetitive motion. With proper education, least amount of stress would be exerted to the body when an action of this type which causes this injury is performed. For example, limited or controlled exposure to a given adverse condition can be obtained by job rotation, etc.

Many hand support devices have been proposed in the art. Various examples are illustrated in U.S. Pat. Nos. 703,211; 1,583,754; 3,074,399; 3,885,249; 4,447,912; 4,883,073; 4,899,763; 4,149,296; 5,256,136; 5,214,799; 4,619,250; 4,502,688; 4,522,197; 4,850,341; 5,031,640; 4,203,495; 4,273,339; 4,624,016; 4,984,828; and 5,003,637; and PCT Publication WO93/00,834.

There is, however, a need in the art for an ergonomic hand support device which prevents or significantly reduces the risk of adverse medical conditions, or prevents from being compounded an already existing condition, such as Carpal Tunnel Syndrome.

OBJECTS AND SUMMARY OF THE INVENTION

The principal object of the present invention is to provide an ergonomic hand support for preventing or significantly reducing the risk of adverse medical conditions that eliminates the drawbacks associated with conventional hand support devices.

Another object of the present invention is to provide a hand support which holds the user's hand in an ergonomically correct position.

Yet another object of the present invention is to provide an ergonomic hand support which holds the user's hand in a comfortable position and eliminates the need for gripping an object, such as a tool or knife, during a work operation thereby preventing or significantly reducing the risk of adverse medical conditions, or preventing from being compounded an existing adverse medical condition, such as Carpal Tunnel Syndrome.

Still yet another object of the present invention is to provide an ergonomic hand support which while holding the user's hand in a comfortable position, does not in any way restrict the user's wrist movement.

Still yet another object of the present invention is to provide an ergonomic hand support which, in addition to relieving any adverse pressure on the carpal tunnel, prevents the exertion of pressure on the median nerve in the palm area of the user.

Yet another object of the present invention is to provide an ergonomic hand support which while holding the user's hand in a comfortable position, permits the user to securely hold and manipulate a work tool, such as a knife, during a work operation.

Still yet another object of the present invention is to provide an ergonomic hand support wherein a tool can be easily fastened or removed. Further, the orientation of the tool relative to the hand support can be easily changed in multiple directions. For example, the tool can be rotated a complete revolution in a horizontal or substantially horizontal plane so as to point in many directions. Moreover, the direction of the tool can be changed in a horizontal plane, in a vertical plane and a plane which intersects the horizontal plane of the hand support.

An additional object of the present invention is to provide an ergonomic hand support which is versatile and has applications in many industries, such as in poultry and meat processing/packaging plants where workers hold a knife throughout the day while deboning meat. Additional areas of applications include holding a tool in an assembly line, holding objects by persons having adverse medical conditions, such as arthritis, high powered pistol target shooting wherein users' palms swell from repeated impact of the pistol's butt against the palm, mountain climbing, spray painting, and in holding powered hand tools.

Yet an additional object of the present invention is to provide an ergonomic hand support which is easy to use and versatile in nature.

Still yet an additional object of the present invention is to provide an ergonomic hand support which is easy to manufacture and maintain.

In summary, the main object of the present invention is to provide an ergonomic hand support which prevents or significantly reduces the risk of adverse medical conditions, and prevents exaggeration of existing adverse medical conditions, normally associated with repetitive motions, an example of which is Carpal Tunnel Syndrome. In addition, the ergonomic hand support of the present invention is very versatile in having a variety of applications in various industries and has commercial as well as noncommercial uses.

BRIEF DESCRIPTION OF THE DRAWINGS

The above and other objects, advantages and other features of the present invention will become apparent from the following detailed description of the invention illustrated in the accompanying drawings, in which.

DETAILED DESCRIPTION OF THE INVENTION

The ergonomic hand support device S of the invention, as best shown in FIGS. 1–6, includes an enclosure member 10 generally having the configuration of a glove to receive a user's hand H. (It should be noted that while a right-handed hand support is disclosed in the FIGS. 1–19, it is well within the scope of this invention to configure the enclosure member 10 for receiving the left hand of a user).

The enclosure member 10 is in the form of a rigid outer shell 12 made of injection molded strong plastic or a lightweight metal. Other conventional material that are generally rigid in nature may also be used in place of plastic or metal. It is, however, preferred that the nature of the material be such that the enclosure member 10 function properly in a broad temperature range from cold to hot when used in a variety of occupations.

Figure 3:
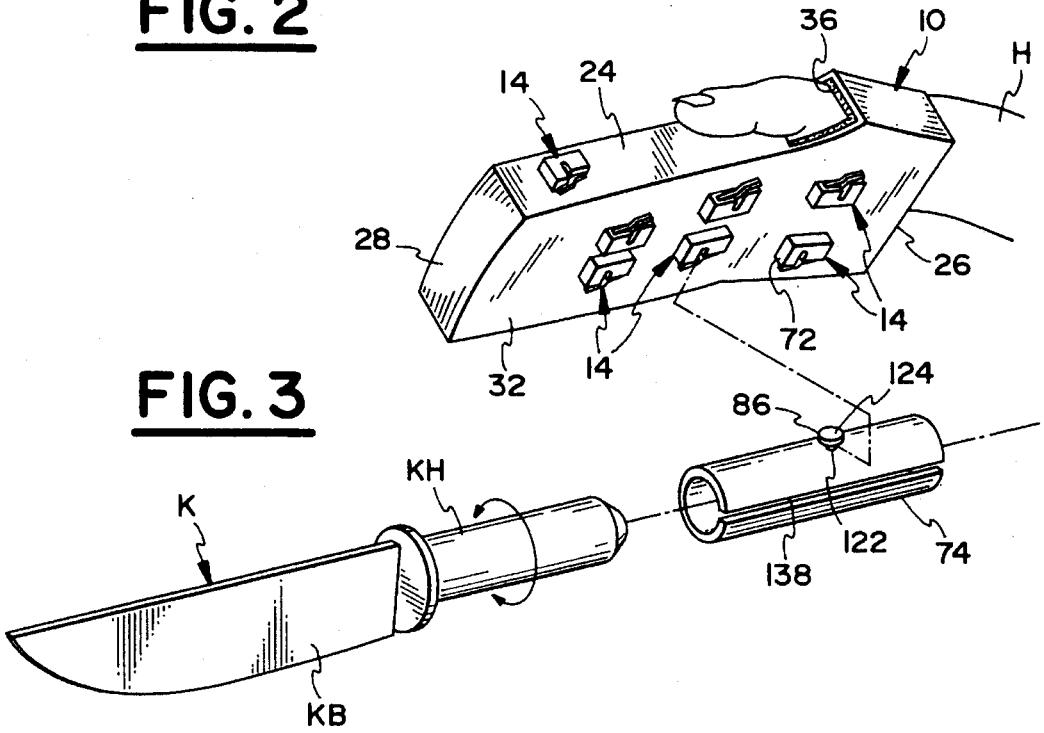
FIG. 3 is a bottom perspective view of the device of FIG. 1 shown with various tool mounts.

As best shown in FIG. 3, object or tool holding mounts 14 are affixed at preselected locations on the hand support S. The exact operation and structure of mounts 14 is described below in detail.

Although not necessary, a resilient padding or cushion 16, which generally corresponds in shape to enclosure member 10, is disposed within enclosure member 10 (FIGS. 1–2, 4–6 and 8–9). The cushion 16 is preferably formed of a low-temperature elastomer or closed cell compressed foam or the like material. The main function of cushion 16 is to provide comfortable padding for the user's hand H.

Figure 1:
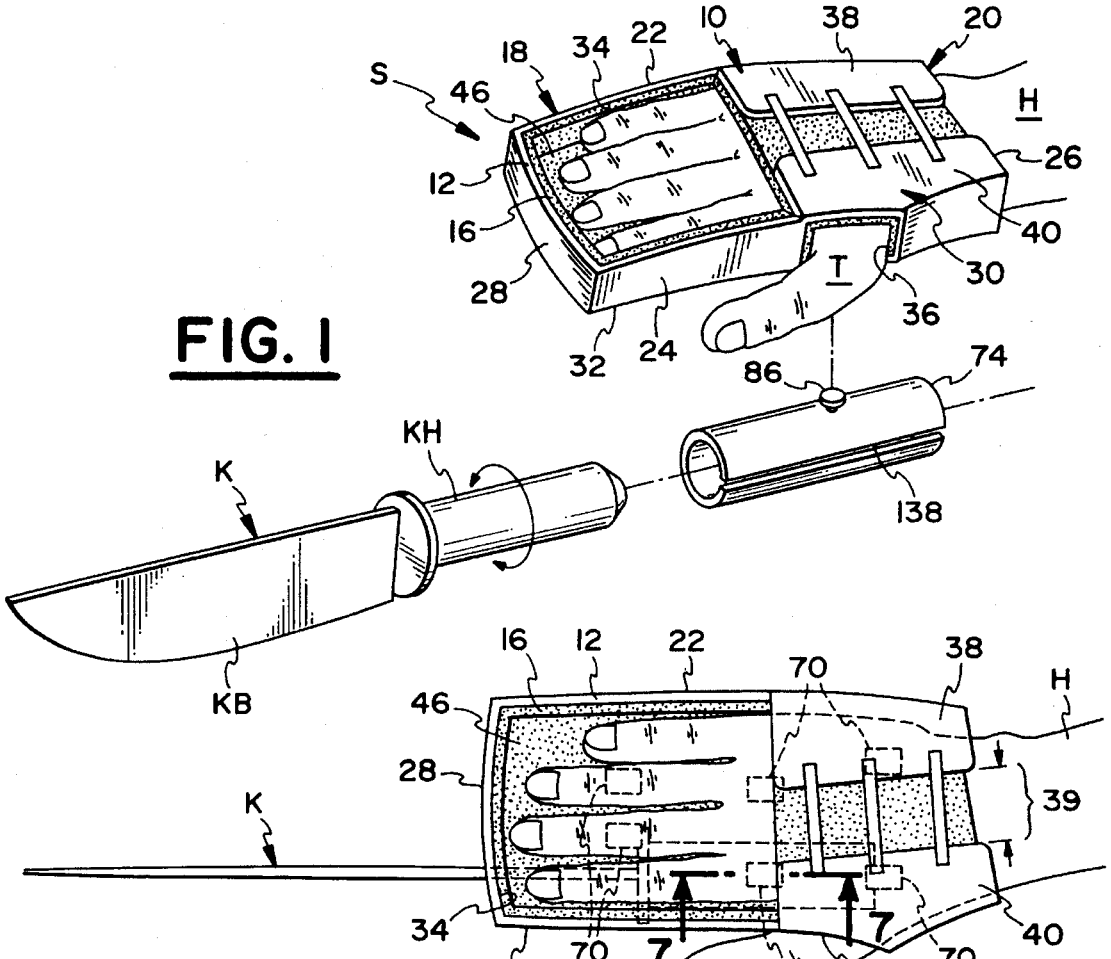
FIG. 1 is a perspective view of the ergonomic hand support device of the present invention partially exploded to show mounting of a knife thereto.
Figure 2:
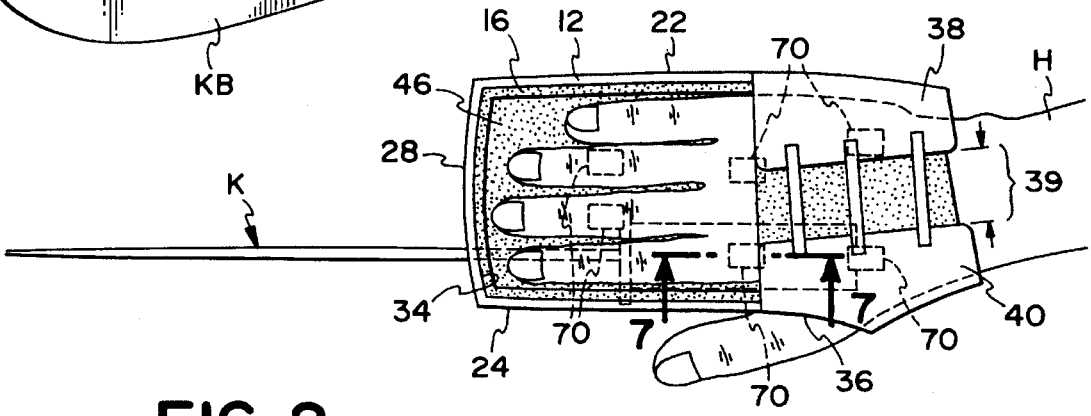
FIG. 2 is a top plan view thereof showing the knife mounted to the device.
Figure 4:
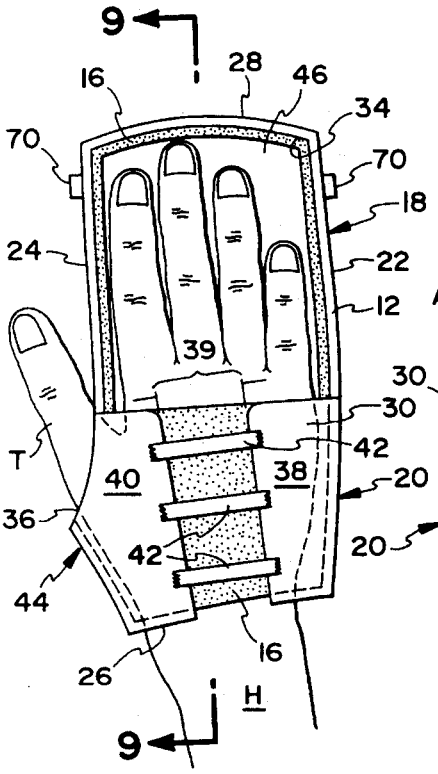
FIG. 4 is a top plan view of the device of FIG. 1 shown without the knife.

As best shown in FIGS. 1–2, the enclosure member 10 includes front portion 18, rear portion 20, and left and right side walls 22 and 24. The rear portion 20 includes opening 26 for inserting therethrough user's hand H. The front portion 18 is closed by front wall 28. The enclosure member 10 further includes top 30 and bottom 32. As best shown in FIGS. 1, 2 and 4, top 30 has an opening 34 in the front portion 18. The right side wall 24 includes an opening 36 for extending therethrough thumb T. It will be apparent to one of those skilled in the art that in a left-handed glove, the thumb opening would be on the opposite side wall.

As noted above, the enclosure member 10 is preferably in the form of an injection molded shell and is therefore of a one-piece construction. The top of rear portion 20 includes two laterally spaced clasp members 38 and 40 which do not fully cover the back of hand H, shown in FIGS. 1, 2 and 4. In other words, the rear portion 20 has a crossectional configuration of an incomplete oval with a top opening corresponding to the top clearance 39 between left and right clasps 38 and 40 (FIG. 4). In this manner, when hand H is inserted into enclosure member 10 through rear opening 26, clasps 38 and 40 function like springs which snug the back and palm area of the hand. As best seen in FIG. 4, clasps 38 and 40 are Connected by elastic fasteners 42 which extend across clearance 39 and allow clasps 38 and 40 to expand when the hand is inserted through rear opening 26.

As bests shown in FIG. 4, the outline configuration of the enclosure member 10 is such that the left and right side walls 22 and 24 generally follow the contours of the hand H in order to allow the hand to rest comfortably inside enclosure member 10. Consistent with this objective, front wall 28 and left side wall 22 are made generally arcuate in shape. In addition, the right side wall 24 forms arch 44 in the area adjacent thumb opening 36. The overall outline configuration of enclosures member 10, therefore, as best seen in FIG. 4, follows the outline contour of hand H.

Figure 8:
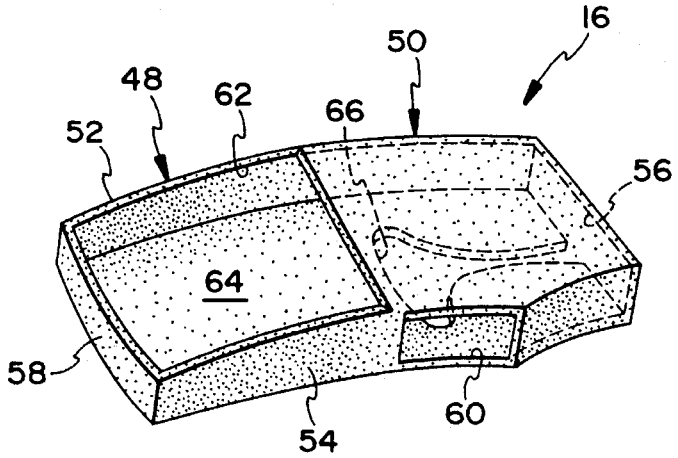
FIG. 8 is a perspective view of the inner cushion.
Figure 9:
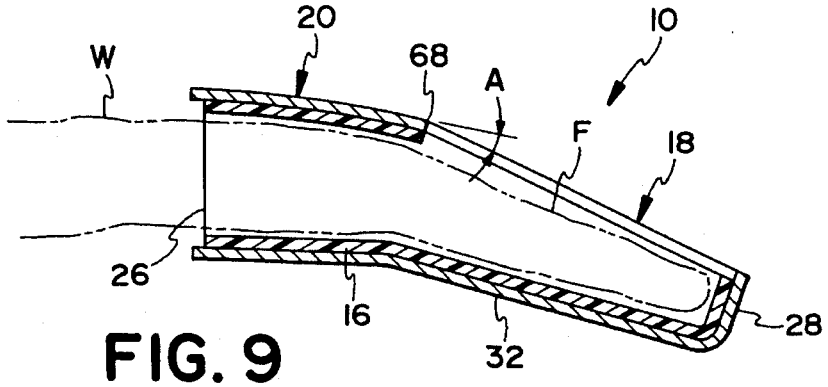
FIG. 9 is a vertical sectional view taken along line 9—9 of FIG. 4.

The front wall 28, top 30, bottom 32, sidewalls 22 and 24, and front and rear portions 18 and 20, together define recess 46 for accommodating the hand therein (FIG. 4). As best shown in FIGS. 8 and 9, cushion 16 has the same overall configuration as enclosure member 10. In particular, cushion 16 includes front and rear sections 48 and 50, respectively. Further, cushion 16 has left and right side walls 52 and 54, and rear opening 56. In addition, front is closed by wall 58. The right side wall 54 includes opening 60 which corresponds to thumb opening 36 of enclosure member 10. The front and rear sections 48 and 50, left and right side walls 52 and 54, rear opening 56 and front wall 58, correspond in shape and configuration to front and rear portions 18 and 20, left and right side walls 22 and 24, rear opening 26, and front wall 28 of enclosure member 10, such that cushion 16 snugly fits within enclosure member 10. It will be noted, however, that rear section 50 of cushion 16 is closed and front section 48 has opening 62 corresponding to opening 34 in enclosure member 10. The bottom 64 of cushion 16 is provided with a generally mushroom shaped cutout 66 in the rear section 50. The cutout 66 generally overlies the area of the palm where the median nerve normally extends. This configuration of cushion 16 prevents the exertion of any indirect pressure on the median nerve.

Figure 5:
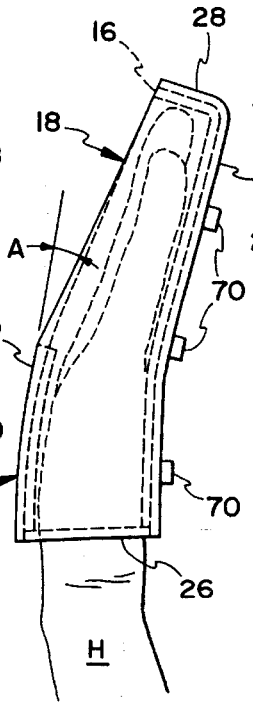
FIG. 5 is a side view of the device shown in FIG. 4.

As best shown in FIGS. 5 and 9, front portion 18 of enclosure 10 extends downwardly away from rear portion 20 and is somewhat tapered in cross section. Preferably, front portion 18 is inclined downwardly at an angle A of about between 10°–45°. Accordingly, the wrist portion W is somewhat arched relative to fingers F thereby providing an ergonomically correct positioning of the hand within hand support S.

Further, as best seen in FIG. 9, the inside height of rear portion 20 is larger than the inside height of front portion 18. This is in correspondence with the varying thickness of the hand H. Further, front portion 18 is somewhat tapered from rear portion 20 toward front wall 28. In other words, the inside height of front portion 18 is largest at the junction 68 between front and rear portions 18 and 20, and gradually decreases to a minimum at front wall 28.

Figure 6:
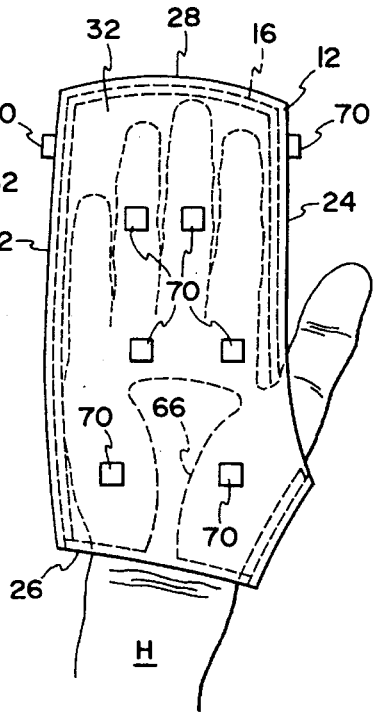
FIG. 6 is a bottom plan view of the device shown in FIG. 4.
Figure 7:
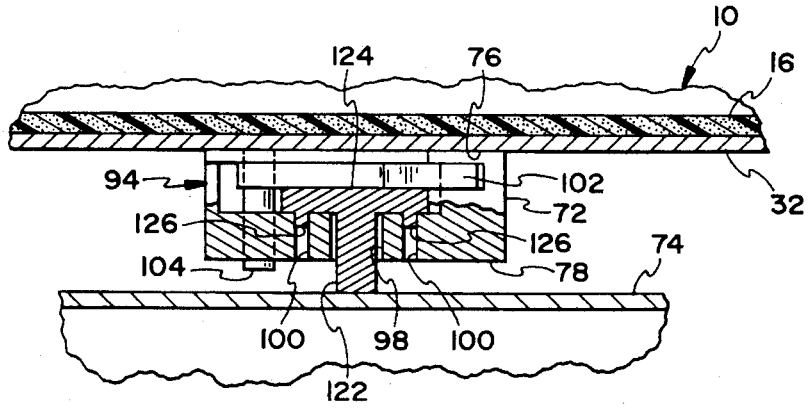
FIG. 7 is a partial enlarged sectional view taken along line 7—7 of FIG. 2.

As noted above, tool holding mounts 14 are mounted on enclosure member 10 at preselected locations thereon for holding objects or tools, such as knife K. As best shown in FIGS. 3 and 5–6, tool mounts 14 are typically mounted on bottom 32 and side walls 22 and 24. It should be noted that while one mount 14 is sufficient for holding a tool, a plurality of tool mounts 14 may be used in conjunction with one another to hold different types of tools, or to provide greater flexibility in orienting a particular tool in accordance with the user's needs and in a variety of applications. In FIGS. 2 and 4–6, square-shaped components designated by reference numeral 70 indicate preferred locations for tool mounts 14.

Figure 10:
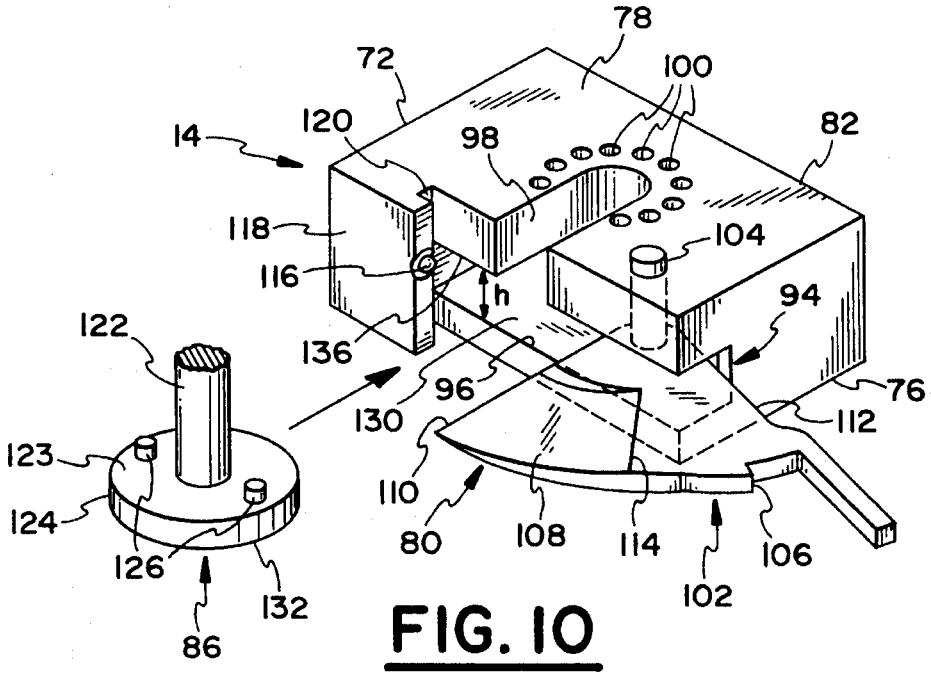
FIG. 10 is an enlarged view showing the tool holding mount.

As best shown in FIGS. 3 and 10, each tool mount 14 includes tool mount housing 72 and tool holder 74. The housing 72 is a generally rectangularly shaped box having top and bottom surfaces 76 and 78, respectively, and front 80 and rear 82. Typically, housing 72 would be mounted to enclosure 10 such that top surface 76 thereof faces bottom 32 of enclosure 10, and bottom 78 thereof faces tool holder 74 (see FIG. 7). Any conventional means may be used to fasten or mount housing 72 to enclosure 10.

As best shown in FIGS. 10–13, housing 72 defines therein recess 84 for receiving tool orientation gear 86. The recess 84 is defined by left wall 88, rear wall 90 and right wall 92. The right wall 92 includes notch 94 the function of which is described below in detail. A generally rectangularly shaped front opening 96 extends horizontally in front 80 and is continuous with notch 94 in right wall 92. The bottom 78 includes "bayonet" slot 98 extending from front 80 towards rear 82. A plurality of holes 100 are provided in bottom 78 and are arranged in a circle around slot 98. The holes 100 extend through the thickness of bottom 78 so as to be in communication with the exterior on one end, and the recess 84 on the other end thereof. Likewise, slot 98 also extends through the thickness of bottom 78 and is in communication with recess 84 and front opening 96. A lock handle 102 pivots about pin 104 and includes projection 106 for locking handle 102 in the housing. The handle 102 is generally triangular in shape and includes cam surface 108 extending from leading edge 110 toward trailing edge 112 thereof. As best shown in FIG. 10, cam surface 108 extends up to about midpoint 114 from leading edge 110 to trailing edge 112. Additionally, the thickness of cam surface 108 gradually increases from a minimum at leading edge 110 to a maximum at midpoint 114, where it essentially merges with the thickness of handle 102.

As best shown in FIG. 10, a spring-biased detent ball 116 is nested in left front wall 118. Upon closing of handle 102 into housing 72, projection 106 snaps past detent ball 116 and gets locked in notch 120 (see FIG. 13). As best shown in FIG. 10, tool orientation gear 86 includes vertical pin 122 centrally mounted on top surface 123 of round disk 124. Two generally opposed orientation pins 126 are also mounted on surface 123, one on either side of pin 122. Preferably, the diameter and the length of pins 126 are significantly smaller than the diameter and length of central pin 122. When tool orientation gear 86 is inserted into housing 72 and lock handle 102 is closed (FIG. 13), orientation pins 126 are received in two corresponding, generally opposed holes 100 for thereby locking the orientation gear 86 in a preselected position. As best shown in FIG. 3, orientation gear 86 is mounted at pin 122 to generally hollow tool holder sleeve 74 (see also FIG. 7).

The thickness of disk 124 is selected so that it is easily inserted through front opening 96 in the housing 72. Likewise, the diameter of disk 124 selected such that it is slightly smaller than the distance d between edge 119 of left front wall 118 and pivot pin 104 (see FIG. 12). In the like manner, the diameter of pin 122 is selected such that it is slightly smaller than the width of slot 98.

It should be noted that when lock handle 102 is in the open position (completely moved away from front opening 96) such that its trailing edge 112 comes to abut front edge 128 of wall 92 (shown in FIG. 12), front opening 96 is completely unobstructed and gear 86 can be easily inserted therethrough. Since the thickness of disk 124 is less than the height h of front opening 96, upon insertion gear 86 would come to rest on bottom 130 of recess 84. However, as lock handle 102 is moved in a clockwise direction to assume the closed position (FIGS. 7, 13 and 14), leading edge 110 would make a contact with bottom 132 of disk 124, and upon continued rotation of handle 102 away from right wall 92, cam surface 108 would elevate tool orientation gear 86 until orientation pins 126 are completely received in the corresponding holes 100, and top 123 of disk 124 comes to engage top surface 136 of recess 84. One of ordinary skill in the art would appreciate that the height h of front opening 96 is selected such that it corresponds to or is more than the combined thickness of disk 124 and lock handle 102. In this regard, it should be noted that for easy manipulation of tool holder 74 relative to tool mount 14 the length of pin 122 should be such that when gear 86 is resting on bottom 130 of recess 84 (FIG. 12), a sufficient clearance is provided between tool holder 74 and bottom 78 of housing 72.

As best shown in FIGS. 1 and 3, tool holder 74 is in the form of a sleeve or hollow tube with a slot 138 that runs the length thereof. (It should be noted that while a preferred form of the tool holder in the shape of a hollow sleeve is shown and described herewith, various other configurations may be used to accommodate the type of tool being used.) The internal diameter of tool holder 74 is selected such that it is slightly smaller than the outside diameter of knife handle KH so that when the handle KH is inserted therethrough, tool holder by virtue of slot 138 expands somewhat and snugly holds knife K. Preferably, tool holder 74 is made of spring steel, however, other conventional material may also be used.

Figure 16:
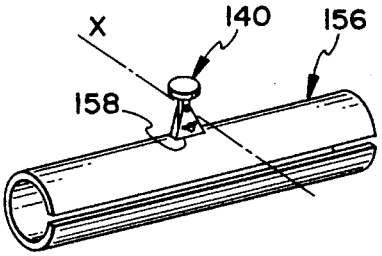
FIG. 16 shows the tool orientation gear of FIG. 15 mounted on the tool holder.
Figure 15:
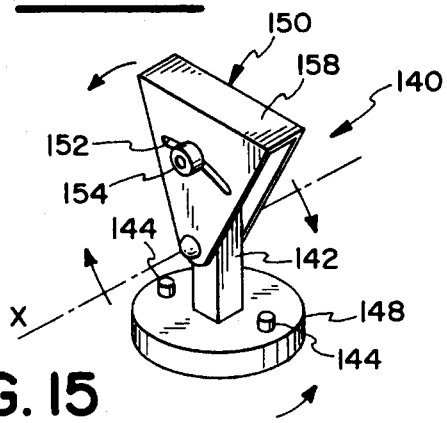
FIG. 15 is an alternate embodiment of the tool orientation gear.

FIGS. 15 and 16 disclose an alternate embodiment of the tool orientation gear. In particular, tool orientation gear 140 includes pin 142 and two orientation pins 144, one on each side thereof, all mounted on disk 148. This embodiment of tool orientation gear 140 further includes saddle member 150 mounted on pin 142 and which pivots about axis x. Saddle 150 includes arcuate slot 152 on one side thereof for extending therethrough tightening screw 154 from pin 142. By loosening screw 154, saddle 150 can be pivoted about axis x and, by tightening it, the preferred position of saddle 150 relative to disk 148, may be selected. The tool orientation gear 140, like tool orientation gear 86, is mounted on a slotted tool holder 156 at its top 158.

USE AND OPERATION

Initially, it should be noted that hand support S of the invention can be used with or without cushion 16. When used without the cushion 16, the user preferably would wear a conventional glove with or without some type of padding inside, and then would slip the hand with the glove on into hand support S. Whether the hand support S of the invention is used with or without cushion 16, the use and operation of it remains generally the same as described below.

Figure 17:
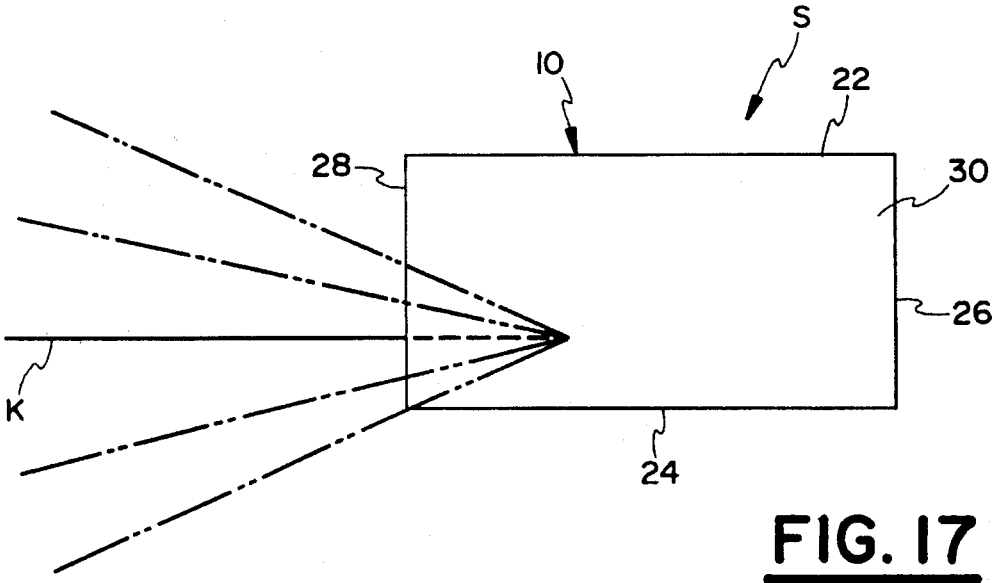
FIG. 17 illustrates schematically in a top plan view multiple orientations of a tool in a plane which is parallel to the horizontal plane of the device of the invention.
Figure 18:
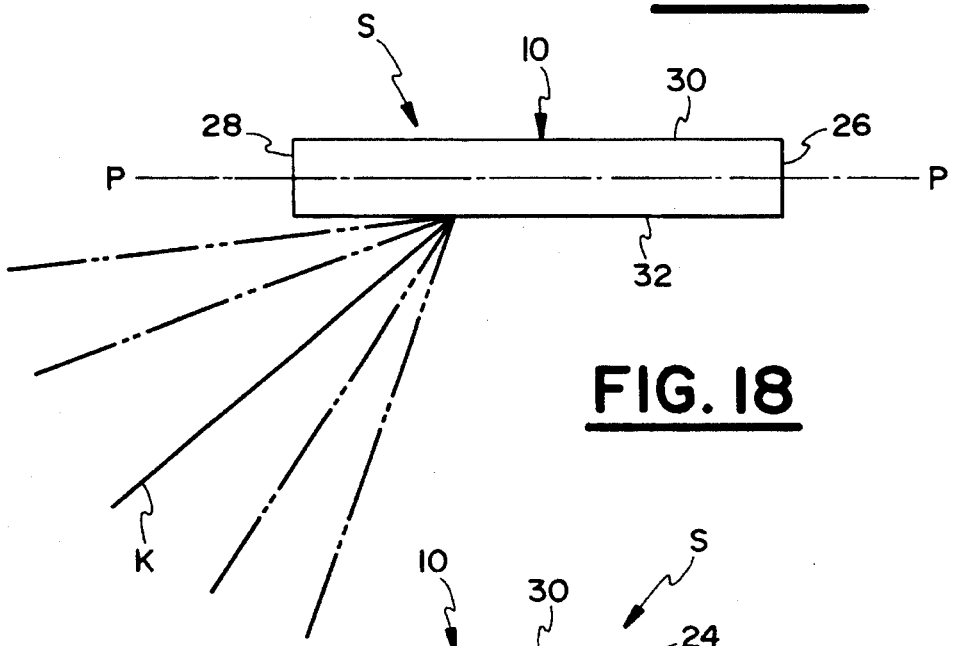
FIG. 18 illustrates schematically in a side elevational view multiple orientations of a tool in a plane which is vertical to the horizontal plane of the device of the invention.
Figure 19:
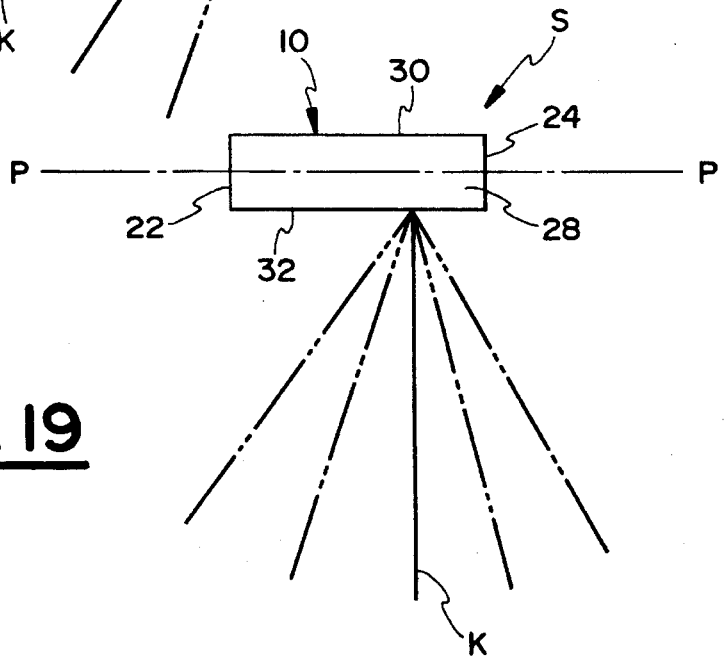
FIG. 19 illustrates schematically in a front elevational view multiple orientations of a tool in a plane which intersects the horizontal plane of the device of the invention.

The hand support S of the invention offers an infinite number of possibilities for the orientation of a tool in at least three distinct planes relative to the horizontal plane of hand support S. First, a tool can be held to extend in many different positions (or directions) in a plane generally parallel to the horizontal plane P of the hand support (FIG. 17). Second, a tool can be held to extend in many different positions (or directions) in a plane vertical to the horizontal plane P of hand support S (FIG. 18). Thirdly, a tool can be oriented along a plane which intersects the horizontal plane P of the hand support (FIG. 19). Accordingly, an infinite number of adjustments in holding a tool relative to hand support S can be made by using the three distinct degrees of freedom offered by the device of the present invention. In addition, a preselected orientation of the tool can be easily varied during use of hand support S without requiring the use of any additional parts or tools in an efficient manner. The hand support of the invention is therefore very versatile and can be used in many different applications.

The steps taken to orient a tool in a preferred direction will now be described. Prior to begin using the hand support S, a user may preselect a preferred orientation of knife K and, more particularly, its blade KB relative to hand support S. This is done by inserting knife handle KH into tool holder 74 (FIG. 3). By rotating knife handle KH within tool holder 74, a preferred orientation of blade KB may be selected. (This type of orientation is schematically illustrated in FIG. 19 wherein Knife K, and particularly knife blade KB, is shown to be held in various positions along a plane which intersects the horizontal plane P of hand support S.)

Once the orientation of knife blade KB has been selected and the knife K has been set in place in tool holder 74, the user then proceeds to fasten tool holder 74 in one of the tool mounts 14. (One of ordinary skill in the art would recognize that this sequence may be reversed, i.e., the tool holder 74 may first be fastened in tool mount 14 and then the direction of knife blade KB is selected by rotating knife handle KH in holder 74). This is done by opening the housing front 80 by rotating lock handle 102 away from left front wall 118 thereof, i.e., rotating in a counterclockwise direction as shown by arrow y in FIG. 11. Once lock handle 102 is moved completely out of the way such that front opening 96 is unobstructed, the user then inserts tool orientation gear 86 in the manner that disk 124 is completely inside recess 84 and orientation pins 126 are in alignment with two opposed holes 100 (see FIG. 12). It should be noted that it would be easier to hold hand support S upside down such that holes 100 face the user in order to facilitate mounting of tool holder 74 in a tool mount 14 and for a preferred orientation of knife K relative to hand support S.

Figure 11:
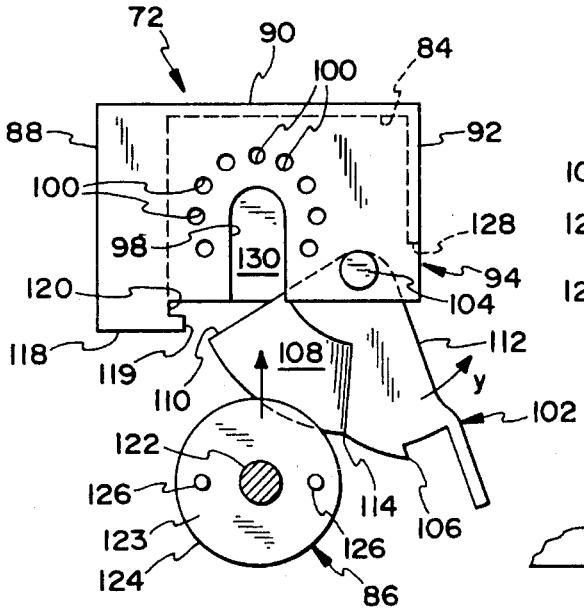
FIGS. 11–13 illustrate opening the tool holding mount, inserting therein tool orientation gear, and locking the orientation gear within the tool holding mount.
Figure 13:
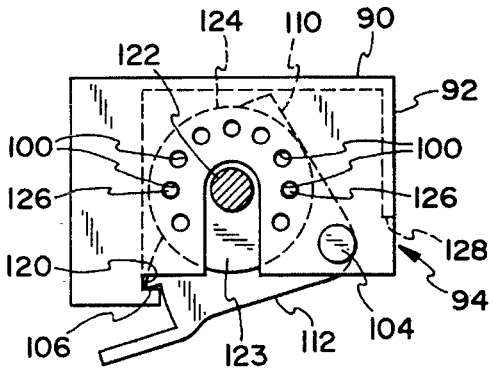
Figure 14:
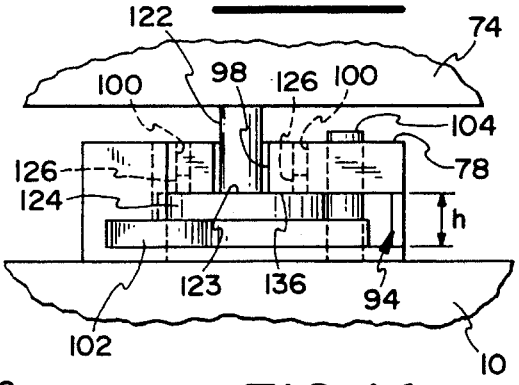
FIG. 14 is a front elevational view of the tool holding mount shown in FIG. 13.
Figure 12:
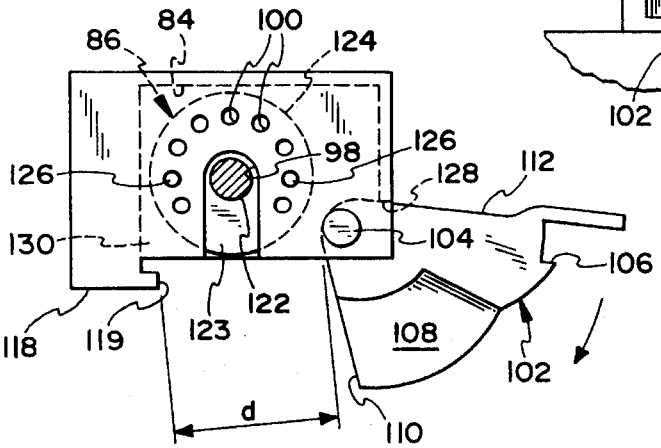

At this point, the user is offered a second degree of freedom for the orientation of knife K relative to hand support S. As noted previously, the user first selected the orientation of knife blade KB relative specifically to the bottom 32 of enclosure 10. By rotating tool holder 74 relative to housing 72 (and thereby rotating disk 124 within recess 84) to align orientation pins 126 with a preferred set of opposed holes 100, the user may select the orientation of knife K in a plane parallel to the horizontal plane of the hand support S (FIG. 17). In order to change the direction of knife K relative to hand support S, as shown in FIG. 2, all the user needs to do is rotate disk 124 in the manner that orientation pins 126 are received in a different set of opposed holes 100. Therefore, once the user has aligned orientation pins 126 with a pair of opposed holes 100 that correspond to a specific direction of the knife K, lock handle 102 can be closed by moving the handle 102 in the clockwise direction, as seen in FIGS. 11–13, such that cam 108 elevates disk 124 and projection 106 gets locked in notch 120. Since orientation pins 126 are received in holes 100 (FIGS. 7 and 12), tool holder 74 becomes immovable and locked in housing 72. The hand support S is now ready for use. (This type of orientation is shown schematically in FIG. 17 wherein knife K is shown to be rotated in a plane parallel to the horizontal plane of hand support S.)

The operation of the alternate embodiment of tool orientation gear 140 shown in FIG. 15 and 16 is the same as tool orientation gear 86 described above, with the exception that gear 140 offers yet a third degree of freedom for orienting knife K. Specifically, since disk 148 is pivotable about axis x, knife K, upon being secured into tool holder 156, can also be pivoted so as to be held generally parallel to bottom 32 or at an angle relative thereto. In other words, by pivoting tool holder 156 relative to the horizontal plane of hand support S, knife K can be oriented so as to extend at an angle thereto in a vertical plane. This is illustrated schematically in FIG. 18.

While this invention has been described as having preferred designs, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What I claim is:

1. An ergonomic hand support for use during a work operation to prevent the risk of adverse medical conditions, comprising:

a) enclosure means generally configured for receiving a user's hand and made of a generally rigid material;

b) said enclosure means including top, bottom, sides, front and rear;

c) said top, bottom, sides, front and rear defining a generally elongated continuous recess for accommodating the user's hand;

d) said recess extending generally the length of said enclosure means;

e) at least one of said sides including a side wall extending from the bottom of said enclosure means;

f) means for substantially immobilizing the user's hand in said recess;

g) means mounted at a preselected location on said enclosure means for releasably holding a work tool;

h) said hand immobilizing means including means for maintaining the user's fingers in a generally planar position; and i) said front being open at the top thereof.

2. The ergonomic hand support of claim 1, and including:

a) cushion means disposed in said recess for supporting the user's hand.

3. The ergonomic hand support of claim 2, wherein:

a) said cushion means substantially corresponds in shape to said enclosure means such that when placed therein said cushion means snugly engages the inside of said enclosure means.

4. The ergonomic hand support of claim 3, wherein:

a) said cushion means includes top, bottom, sides, front and rear generally corresponding in size to the top, bottom, sides, front and rear of said enclosure means; and b) said cushion means includes a cut-out in the bottom thereof for relieving pressure over the palm area of the user's hand.

5. The ergonomic hand support of claim 1, wherein:

a) said front extends away at an angle from said rear.

6. The ergonomic hand support of claim 1, wherein:

a) said recess comprises first and second areas;

b) said first area of said recess having a configuration for accommodating together a plurality of the fingers of the user; and c) said second section of said recess having a configuration for accommodating the palm area of the user's hand.

7. The ergonomic hand support of claim 6, wherein:

a) one of said sides includes an opening for extending therethrough the user's thumb.

8. The ergonomic hand support of claim 1, wherein:

a) said hand immobilizing means further comprises at least one fastener means disposed adjacent the rear of said enclosure means.

9. The ergonomic hand support in claim 1, wherein:

a) said enclosure means extends in a horizontal plane; and b) said tool holding means includes means for orienting the work tool in a preselected direction relative to the horizontal plane of said enclosure means.

10. The ergonomic hand support of claim 9, wherein:

a) said tool orientation means includes means for varying the direction of the tool in a plane generally parallel to the horizontal plane of said enclosure means.

11. The ergonomic hand support of claim 9, wherein:

a) said tool orientation means includes means for varying the direction of the tool in a plane intersecting the horizontal plane of said enclosure means.

12. The ergonomic hand support of claim 9, wherein:

a) said tool orientation means includes means for varying the direction of the tool in a plane intersecting the horizontal plane of said enclosure means generally at right angle thereto.

13. The ergonomic hand support of claim 9, wherein:

a) said tool orientation means includes means for rotating the tool relative to said enclosure.

14. The ergonomic hand support of claim 9, and including:

a) means for locking the tool in a preselected direction.

15. An ergonomic hand support for use during a work operation to prevent the risk of adverse medical conditions, comprising:

a) enclosure means generally configured for receiving a user's hand and made of a generally rigid material;

b) said enclosure means including top, bottom, sides, front and rear;

c) said top, bottom, sides, front and rear defining a generally elongated continuous recess for accommodating the user's hand;

d) said recess extending generally the length of said enclosure means;

e) said sides each including a side wall extending from the bottom of said enclosure means;

f) one of said sidewalls including an opening for extending therethrough a thumb of the user;

g) cushion means disposed in said recess for supporting the user's hand;

h) means for substantially immobilizing the user's hand in said recess;

i) means mounted at a preselected location on said enclosure means for releasably holding a work tool;

j) said hand immobilizing means including means for maintaining the user's fingers in a generally planar position; and k) said front being open at the top thereof.

16. The ergonomic hand support of claim 15, wherein:

a) said tool holding means includes means for orienting the work tool in a preselected direction relative to said enclosure means.

17. The ergonomic hand support of claim 16, wherein:

a) said tool orientation means includes means for rotating the tool relative to said enclosure means.

18. The ergonomic hand support of claim 16, and including:

a) means for locking the tool in a preselected direction.

19. The ergonomic hand support of claim 15, wherein:

a) said enclosure means extends in a horizontal plane; and, b) said tool orientation means includes means for varying the direction of the tool in a plane intersecting the horizontal plane of said enclosure means.

20. An ergonomic hand support for use during a work operation to prevent the risk of adverse medical conditions, comprising:

a) enclosure means generally configured for receiving a user's hand and made of a generally rigid material;

b) said enclosure means including top, bottom, sides, front and rear;

c) said top, bottom, sides, front and rear defining a generally elongated continuous recess for accommodating the user's hand;

d) said recess extending generally the length of said enclosure means;

e) at least one of said sides including a side wall extending from the bottom of said enclosure means;

f) means for substantially immobilizing the user's hand in said recess;

g) means mounted at a preselected location on said enclosure means for releasably holding a work tool;

h) cushion means disposed in said recess for supporting the user's hand;

i) said cushion means substantially corresponding in shape to said enclosure means such that when placed therein said cushion means snugly engages the inside of said enclosure means;

j) said cushion means including top, bottom, sides, front and rear generally corresponding in size to the top, bottom, sides, front and rear of said enclosure means; and k) said cushion means including a cut-out in the bottom thereof for relieving pressure over the palm area of the user's hand.

21. An ergonomic hand support for use during a work operation to prevent the risk of adverse medical conditions, comprising:

a) enclosure means generally configured for receiving a user's hand and made of a generally rigid material;

b) said enclosure means including top, bottom, sides, front and rear;

c) said top, bottom, sides, front and rear defining a generally elongated continuous recess for accommodating the user's hand;

d) said recess extending generally the length of said enclosure means;

e) at least one of said sides including a side wall extending from the bottom of said enclosure means;

f) means for substantially immobilizing the user's hand in said recess;

g) means mounted at a preselected location on said enclosure means for releasably holding a work tool;

h) said enclosure means extending in a horizontal plane;

i) said tool holding means including means for orienting the work tool in a preselected direction relative to the horizontal plane of said enclosure means; and j) said tool orientation means including means for rotating the tool relative to said enclosure.

22. An ergonomic hand support for use during a work operation to prevent the risk of adverse medical conditions, comprising:

a) enclosure means generally configured for receiving a user's hand and made of a generally rigid material;

b) said enclosure means including top, bottom, sides, front and rear;

c) said top, bottom, sides, front and rear defining a generally elongated continuous recess for accommodating the user's hand;

d) said recess extending generally the length of said enclosure means;

e) said sides each including a side wall extending from the bottom of said enclosure means;

f) one of said sidewalls including an opening for extending therethrough a thumb of the user;

g) cushion means disposed in said recess for supporting the user's hand;

h) means for substantially immobilizing the user's hand in said recess;

i) means mounted at a preselected location on said enclosure means for releasably holding a work tool;

j) said enclosure means extending in a horizontal plane; and, k) said tool holding means including means for varying the direction of the tool in a plane intersecting the horizontal plane of said enclosure means.

23. An ergonomic hand support for use during a work operation to prevent the risk of adverse medical conditions, comprising:

a) enclosure means generally configured for receiving a user's hand and made of a generally rigid material;

b) said enclosure means including top, bottom, sides, front and rear;

c) said top, bottom, sides, front and rear defining a generally elongated continuous recess for accommodating the user's hand;

d) said recess extending generally the length of said enclosure means;

e) said sides each including a side wall extending from the bottom of said enclosure means;

f) one of said sidewalls including an opening for extending therethrough a thumb of the user;

g) cushion means disposed in said recess for supporting the user's hand;

h) means for substantially immobilizing the user's hand in said recess;

i) means mounted at a preselected location on said enclosure means for releasably holding a work tool;

j) said tool holding means including means for orienting the tool in a preselected direction relative to said enclosure means; and k) said tool orientation means including means for rotating the tool relative to said enclosure means.

* * * * *